US005158510A

United States Patent [19]

Lemire

[11] Patent Number: 5,158,510

[45] Date of Patent: Oct. 27, 1992

[54] EXERCISE BELT AND TETHER

[76] Inventor: Brett J. Lemire, 7200 S. Land Park Dr. #200, Sacramento, Calif. 95831

[21] Appl. No.: 754,039

[22] Filed: Sep. 3, 1991

[51] Int. Cl.[5] ..... A63B 22/00

[52] U.S. Cl. ..... 482/51; 52/57; 52/74

[58] Field of Search ..... 272/139, 142, 136, 135, 272/119, 122, 123, 143; 128/78

[56] References Cited

U.S. PATENT DOCUMENTS

| | | | |
|---|---|---|---|
| 936,006 | 10/1909 | Matzner . | |
| 1,372,026 | 3/1921 | Hutter . | |
| 1,734,238 | 11/1929 | Sweeney . | |
| 2,166,777 | 7/1939 | Walker . | |
| 2,317,346 | 4/1943 | Reith . | |
| 4,169,518 | 10/1979 | Schmoock . | |
| 4,960,276 | 10/1990 | Feuer | 272/70 |
| 4,991,573 | 2/1991 | Miller | 128/78 |

FOREIGN PATENT DOCUMENTS

| | | | |
|---|---|---|---|
| 807392 | 1/1937 | France | 272/134 |
| 95855 | 8/1922 | Switzerland | 272/136 |
| 21999 | of 1899 | United Kingdom | 272/136 |

*Primary Examiner*—Richard J. Apley
*Assistant Examiner*—Jerome Donnelly

[57] ABSTRACT

A support belt having a removably affixed elongated tether which is attachable to an exercise machine, and a method of use thereof. The belt may be adjustably affixed around a person's waist, and includes a centrally grooved pad for placement adjacent the spine in the lumbar area of the wearer. The tether is manually adjustable in length for initial large increment adjustments as required for different exercise machines and individuals, and includes one or more elastic members to allow for automatic small increment length adjustability to provide shock absorption, a generally constant level of pressure against the user, and for freedom of movement during use. One end of the tether removably affixes to eyelets or rings affixed to the support belt. The opposite end of the tether is structured for removable attachment to a central structural member of an exercise machine directly in front of the user's abdomen. The invention comfortably supports and urges the wearer into a substantially upright position to take strain off back muscles while using an exercise machine of the type allowing alternating leg movements such as a stair stepping machine or stationary bicycle and the like.

2 Claims, 8 Drawing Sheets

EXERCISE BELT AND TETHER

BACKGROUND OF THE INVENTION

1. Field of the Invention

This invention relates to exercising and exercise equipment in general. The invention includes a belt worn about the waist which has a tether which is attachable to an exercise machine, and a method of using a belt and tether on a person utilizing exercise equipment primarily of the type involving alternate leg motion, such as a stair stepping machine, stationary bicycle, or the like. Support and pulling pressure provided by the belt and tether promotes and assists in maintaining proper spinal alignment during exercise in order to reduce or eliminate muscle strain and the pain associated therewith, particularly in the lower back.

2. Description of the Prior Art

A variety of belts are available for wearing during physical activity. Some of these belts have been incorporated into various types of exercise equipment with the use of relatively strong elastic members or springs which provide resistance to movement for exercising various parts of the body. Although such resistance exercise equipment is different than the invention of this disclosure, there are some similarities in structure, but not in use or benefit. One prior art exercise belt is incorporated into a physical exercising apparatus shown in U.S. Pat. No. 1,734,238, issued to H. C. Sweeney on Nov. 5, 1929. Sweeney's resistance exercise device for the arms and legs is comprised of an elongated belt structured to encircle the user's waist, with the belt ends extending outward approximately arms length. The ends of the belt are affixed with relatively strong extension springs which are in turn affixed to a stationary base. Sweeney's extension springs are structured to provide for a relatively long throw between a relaxed and an extended position, which is typical of resistance exercise equipment, to provide for exercising the legs over the full range of motion.

A patent for an exercise apparatus was issued to W. H. Hutter on Mar. 22, 1921, U.S. Pat. No. 1,372,026. Hutter's resistance exercising device includes a loop for placement over the head, neck, or body. The loop is additionally structured for attachment to a rope or connecting structure. The connecting structure is movably affixed to a stationary base where tension is applied to provide resistance to movement.

Although not particularly relevant to my invention, tethered belts structured primarily as safety belts are shown in U.S. Pat. Nos. 4,169,518, 2,317,346, 936,006, and 2,166,777. Safety belts are primarily structured and directed for use by telephone pole climbers or window washers, and normally would not include any elastic or springs in the tether or belt, or the necessary structuring for connecting the tether properly to certain structural members of exercise equipment.

Americans have become more health conscious over the years, and the use of exercise equipment has increased dramatically. Along with the dramatic increase in the use of exercise equipment has come a correspondingly dramatic increase in injuries and chronic pain due to either poorly designed exercise equipment or the improper use of the equipment. Certain types of exercise equipment, such as those involving the alternate use of the legs, for example the newer stair stepping machines and stationary bicycles, tend to create strain on the user's back due to the user not maintaining proper body alignment while exercising. The stair stepping exercise equipment basically includes two vertically movable steps which simulate the effect of the user climbing a flight of stairs. As one step of the machine moves downward, the other step moves upward. The user of the stair stepping machine or stationary bicycle, after a period of time, tends to assume a forward bent over position which eventually exerts stress on the lower back often leading to pain.

The known prior art devices do not provide sufficient structure or instructions for use for applying the proper pressures in the correct areas for urging a person into a desireable body alignment when used in conjunction with certain types of exercise equipment. Additionally, the prior art does not provide the necessary tether length adjustability which is needed for acquiring different degrees of support desired by individual wearers, and for various exercise machines which require different lengths of tethers. Therefore, there has developed a need for an exercise belt with tether, and a method of use thereof to help promote and maintain proper body alignment, and thereby reduce or eliminate muscle strain from use of exercise equipment.

SUMMARY OF THE INVENTION

The invention of this disclosure includes a waist belt with an elongated tether, and a method of using same. The belt and tether when properly structured and utilized proves to be very comfortable for the user to wear during use of certain exercise machines, encourages correct posture and body alignment, which in turn reduces or eliminates muscle strain, particularly in the lower back. The belt with tether is structured to provide support and pulling pressure to promote proper spinal alignment of a person utilizing exercising equipment primarily of the type involving alternate leg motion, such as a stair stepping machine, stationary bicycle and the like. Such exercise machines require the alternating movement of the legs, but otherwise the waist of the person remains relatively stationary. My invention in one form includes the widened belt preferably having thickened padding at least in the area thereof which is placed adjacent the lumbar area during use. The belt is of a length to be adjustably attachable around the user's waist. The belt is additionally structured for releasable connection to a first end portion of the elongated tether. The opposite end of the tether or a second portion thereof may be releasably attached to an existing central structural member of the exercise equipment. The tether should be fastened to a stationary structural member of the exercise machine which is positioned directly in front of the person's abdomen. The tether is manually adjustable in length for initial large increment adjustments as required for various distances between the front of the user and the central member of the exercise machine to which the one end of the tether is affixed. The manual adjustment to the length of the tether is made initially before beginning to exercise, and then affixed at the length with a fastener such as a buckle. Additionally, the tether, or possibly even a portion of the belt or both, is preferably at least in part elasticized to allow for automatic small increment length adjustability between the belt and the member of the exercise machine to which the second end of the tether is attached. The automatic small incrment length adjustability is to provide shock absorbtion, a generally constant level of pressure against the user's waist, and for freedom of movement during use. The amount of automatic small increment length adjustability is generally restricted to a maximum lengthening in order to provide proper support and comfort to the user.

When a person is using a stair stepping machine or stationary bicycle without using my invention, there is a tendency for them to lean forward to redistribute their weight, especially when the equipment is used at high speeds for long periods. While the bent over position may feel more comfortable for the moment, over an extended period of time, this abnormal posture and spinal alignment will create strain on certain muscles of the back, often causing chronic pain to the person. With the use of my invention, the person is urged to lean back into a more upright position, preferably still holding the hand rails of the exercise machine, while being gently supported, particularly with pressure applied to the lumbar area by the belt and tether. The tension applied to the belt by a properly adjusted tether applies pressure in the waist and lumbar area of the user. This tension or pressure tends to pull the waist area of the user toward the structural member of the exercise machine to which one end of the tether is attached. It has been found that a small amount of pressure pulling the user's waist forward causes the user to naturally move his shoulders more rearward, position his spine in a more correct alignment, lean slightly rearward into the belt, and reduce his tendency toward bending forward at the waist.

The degree of elasticity of the tether is preferably such that it provides a large and increasing amount of resistance when the user leans too far back, being strong enough to support the user within a given horizontal positional range. The elasticity also compensates, by allowing automatic length adjustments for a degree of forward and rearward movement of the user's waist, and for the natural side to side rotation experienced by the user during alternating leg movement with use of the exercise equipment. The degree of resistance of the elasticity under normal use allows an expansion range of about 3 to 12 inches before the elastic member approaches the designed stretch limit, and resistance to further stretching and the resultant lengthening is greatly restricted. The elastic member, as is the case of most springs or elasticized members provides increasing resistance to further stretching as the elastic member approaches the designed stretch limit. Through the large increment length adjustability of the tether, the user can initially set the desireable amount of pressure applied by the tether against the belt, a situation where the elastic member of the invention will be slightly extended when the person's waist is positioned the proper distance for exercising from the structural member of the exercise machine to which the one end of the tether is attached, for example with the user sitting on the seat of an exercise bicycle. The pressure applied to the belt by the tether translates into a degree of pressure applied to the entire waist area, and particularly the lumbar area of the wearer. Most people will normally choose to apply somewhere between 3 to 50 pounds of pressure against the tether depending on their body size and physical condition. Different strengths of elastic members will need to be used for heavy people relative to people having a much lower body weight. The different strengths of elastic may be provided in different tether assemblies selected by the user, or may be provided by the user either applying or removing additional spring or elastic members to the tether and belt assemblage as needed. For the purpose of this disclosure, a spring and an elastic member are viewed as essentially the same.

If insufficient pressure is applied to the belt by the tether, the user would not be provided with sufficient pull against the waist and lower back to urge the user into an upright or even slightly hyper-extended position. Excessive pressure would not provide the desirable shock absorbing effect and freedom of movement, and would be uncomfortable for the user.

Additionally, with the tether detached from one preferred belt, the belt is structurally suitable for use as a general exercise support belt or weight lifting support belt, being able to be adjustably tightened around the user's waist to give support to abdominal and lower back muscles.

Therefore, a primary object of the invention is to provide an exercise belt with a tether and a method of use thereof which helps promote proper body and spinal alignment when used in conjunction with exercise equipment.

A further object of the invention is to provide the above in which the tether is manually adjustable in length for large increment adjustments as required, and includes one or more springs or elastic members to provide automatic small increment length adjustability for shock absorbtion, relatively constant pressure against the user, and for freedom of movement during use.

An even further object of the invention is to provide the above in which the automatic small increment length adjustability is generally restricted to a maximum extension of somewhere around 3 to 12 inches with normal use where somewhere between 3 to 50 pounds of pressure is applied to the belt and tether by the user.

Another object of the invention is to provide the above in an exercise belt and tether where preferably the belt portion of the device may be used alone as a general exercise or weight lifting belt when the tether has been detached from the belt, and thereby increase the overall usefulness of the apparatus to the user.

Other objects and advantages of my invention will be ascertained from the remaining specification, along with comparison of the accompanying drawings.

BEST MODES FOR CARRYING OUT THE INVENTION

Figure 1:
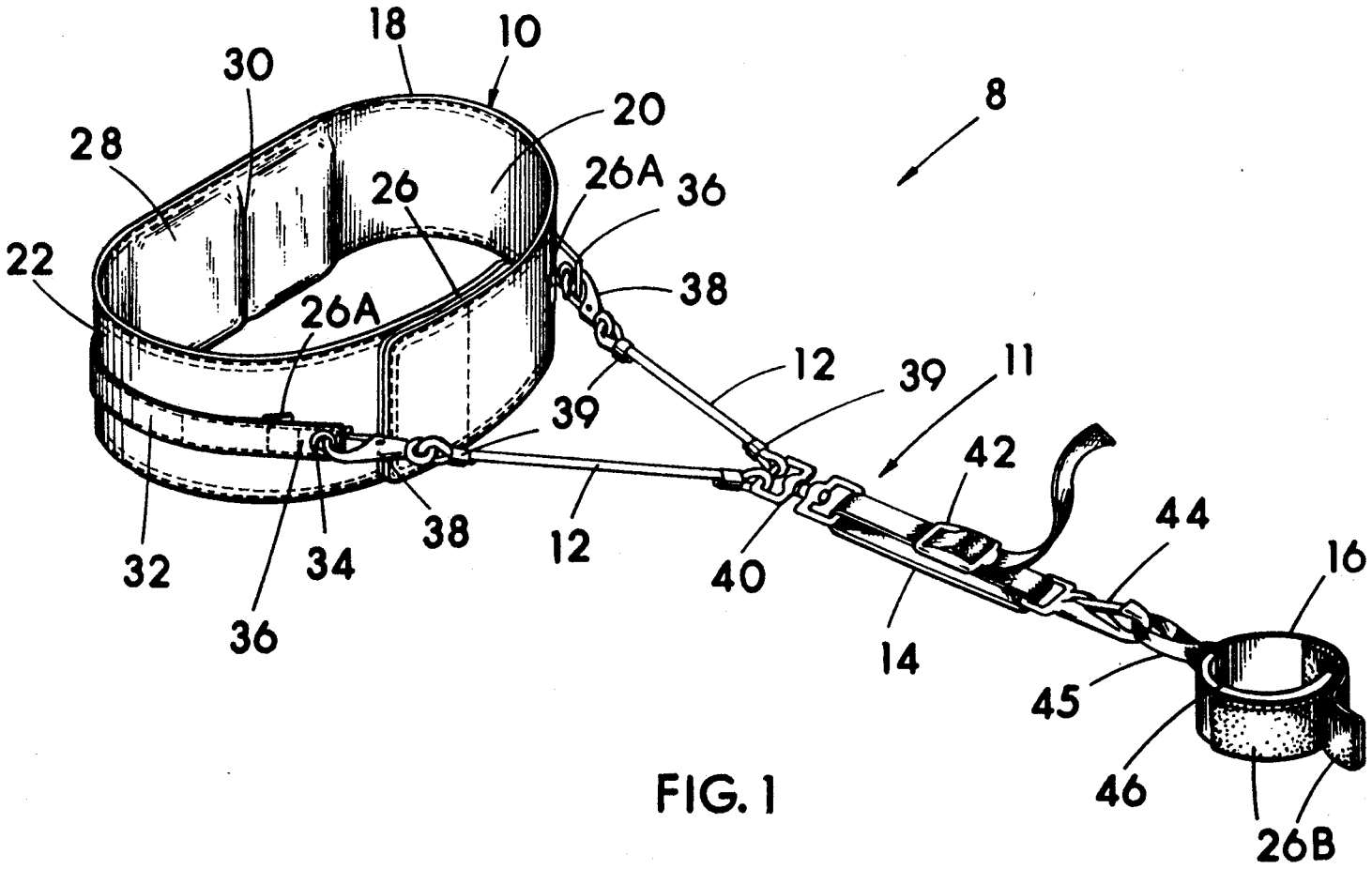
FIG. 1 is a perspective frontal view of a first preferred structural embodiment of belt and tether.
Figure 2:
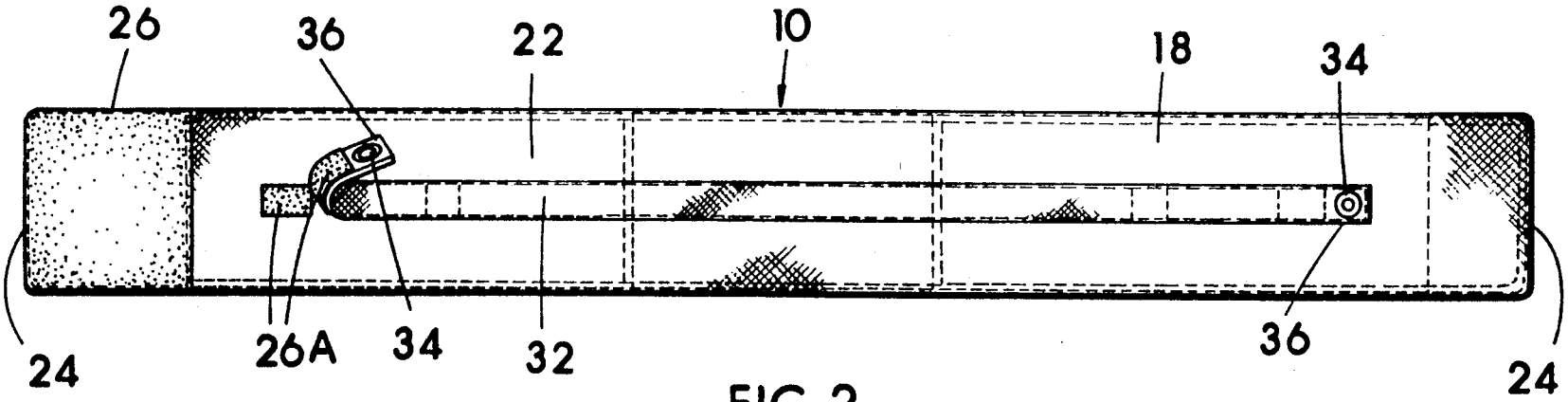
FIG. 2 is an exterior or rear plan view of the belt of the embodiment of FIG. 1.
Figure 3:
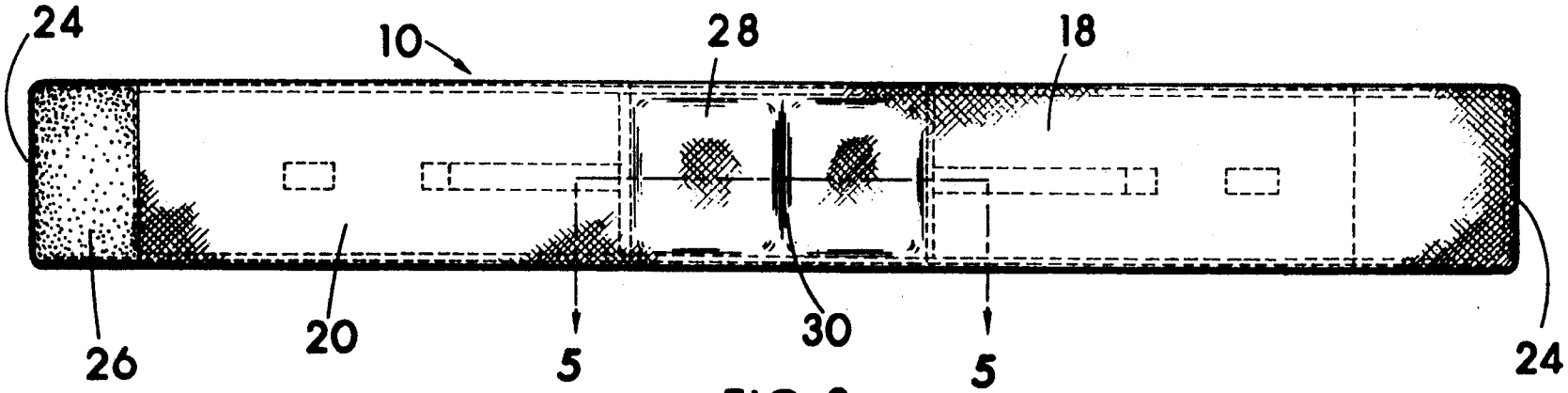
FIG. 3 is an interior or frontal view of the belt of the embodiment of FIG. 1.

Referring now to the drawings, and particularly FIGS. 1 through 7 where a first structural embodiment 8 of a suitable belt 10 and tether 11 combination is illustrated. Tether 11 includes two belt connecting members 12, adjustable strap 14, and attachment strap 16 which will be described in detail later. Belt 10 is comprised of an elongated flexible rectangular panel 18 feasibly manufactured of two sewn together layers of heavy flexible fabric such as canvas or the like. Panel 18 has an interior surface 20 which is placed against the body in use, and an oppositely disposed exterior surface 22. Panel 18 has two oppositely disposed free ends 24 shown best in FIGS. 2 and 3. Affixed adjacent each of the free ends 24 by sewing or other suitable methods are relatively wide and long sections of hook and loop fasteners 26. One section of hook and loop fastener 26 is affixed to the exterior surface 22 while the other section of fastener 26 is affixed to the opposite end 24 onto interior surface 20. Hook and loop fasteners 26 of ends 24 allow panel 18 to be wrapped around a person's waist and ends 24 overlapped and secured together, also allowing a certain degree of adjustability based on the length of the hook and loop fasteners 26 to accommodate different sizes of waists and choices of tightness of the belt 10. Two or three sizes of belts 10 may need to be provided to accommodate widely varying waist sizes.

Positioned between the layers of panel 18, generally midway between both ends 24, is a pad 28 which is positioned in the lumbar area during use. Pad 28 may be feasibly manufactured as a rectangular section of semi-rigid foam rubber or other suitable padding material such as fiber stuffing. Pad 28 may be affixed stationary in belt 10 by sewing or adhesives for example. Pad 28 preferably includes a central groove 30 extending transversely across one broad surface thereof shown best in FIGS. 1, 3, and 5. Groove 30 may be formed by sewing through both layers of fabric of belt 10 and through the center of pad 28, particularly a pad 28 made of fiber stuffing, or by molding the groove into a rubber pad, or by molding and sewing in combination. Groove 30 faces interior surface 20, and is slightly wider than the human spine so that during use of belt 10, groove 30 straddles and parallels the spine, while the padding on each side of groove 30 presses against the back in the lumbar area on each side of the spine, an arrangement which reduces or prevents excess pressure from being applied directly onto the spine in the lumbar area, thereby adding to comfort and greater stability of belt 10 on the person.

Affixed centrally longitudinally to exterior surface 22 of panel 18 by sewing or other suitable methods is an elongated flexible strap 32. Strap 32 is slightly shorter in length than panel 18 and is affixed stationary onto exterior surface 22 except for short sections of each terminal end of strap 32 which are left free to form tabs 36. Tabs 36 are set-back slightly from hook and loop fasteners 26, but are essentially placed to be on oppositely disposed exterior frontal sides of belt 10 during use as one may ascertain from FIG. 1. Tabs 36 each contain a reinforced aperture or eyelet 34 to allow releasible attachment of tether 11 thereto. Affixed by sewing or other suitable methods to tabs 36, adjacent each eyelet 34, is a small section of hook and loop fastener 26 A, the mating fastener section of which is affixed to exterior surface 22 of panel 18 and shown best in FIG. 2. Hook and loop fastener 26 A allows tabs 36 to be releasably attached to the surface of panel 18 when not in use with tether 11 to prevent them from hanging loose and possibly interfering with general exercise or weight lifting when belt 10 is being used without tether 11. Strap 32 may be non-elastic or may be elastic material. An elastic strap 32 would supply elastic tabs 36 on belt 10 which may be a suitable substitute or an additional location for the desireable elasticity which may otherwise be supplied as a structural component of tether 11 as will be described. Although belt 10 has been described as being manufactured of heavy layered fabric, it is conceivable it could be made of leather, whether layered or not, and with or without pad 28. If belt 10 is made of non-layered leather, and pad 28 is desired on this leather belt, the pad 28 could be affixed and left exposed on one side of the belt in the center. The tabs 36 could be attached as two short separate units stitched to the leather belt.

Figure 4:
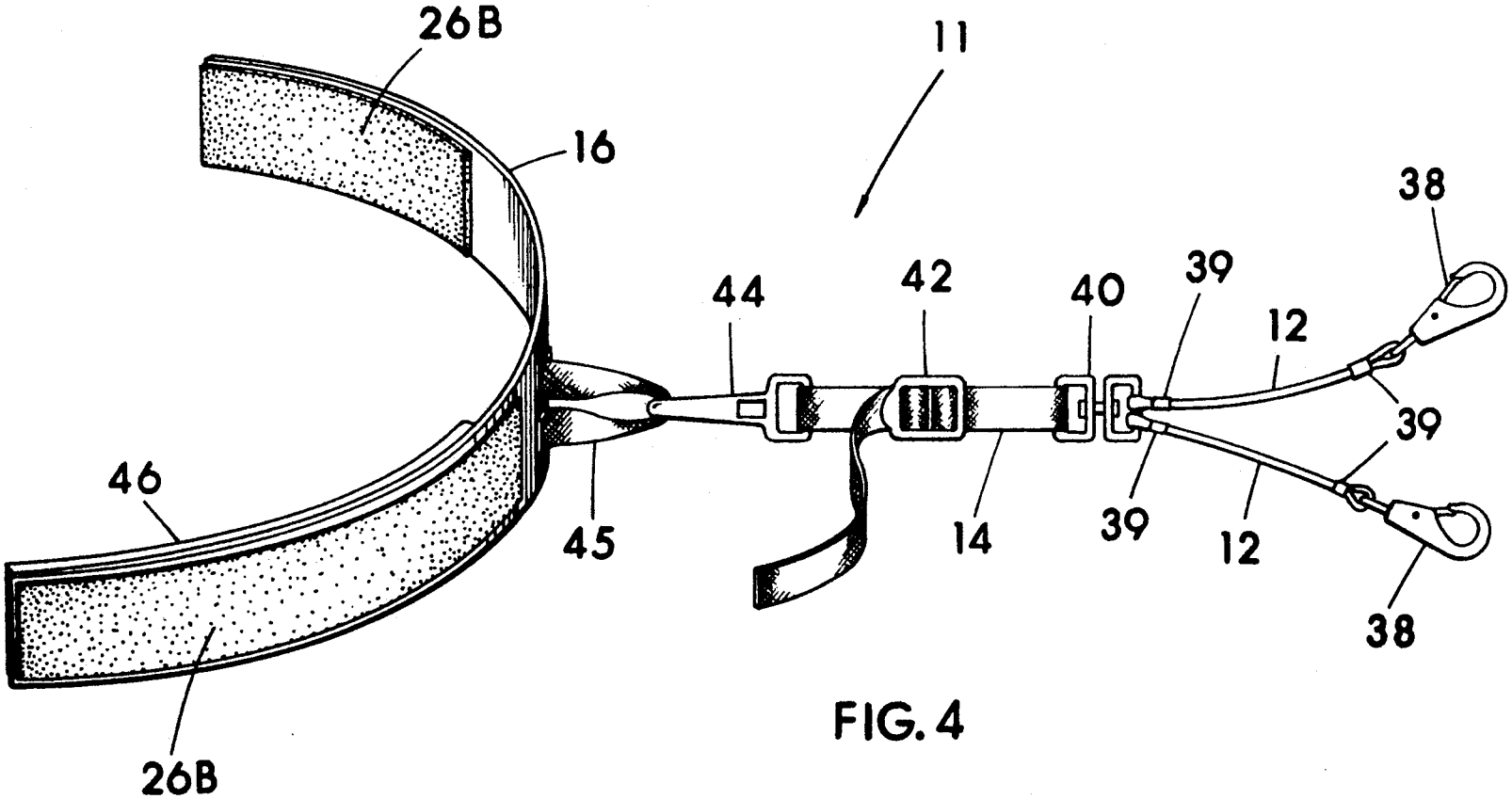
FIG. 4 is a perspective view of the tether of the embodiment of FIG. 1.
Figure 5:
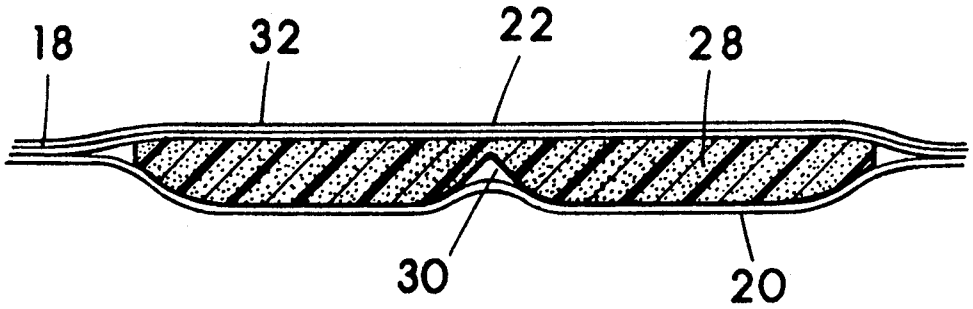
FIG. 5 is a cross section of the central padding portion of the belt taken at line 5 of FIG. 3.

Tether 11 includes two belt connecting members 12 which may be made up of lengths of elongated fabric covered rubber elastic cords, each affixed on one end with a releasable swivel-eye snap fastener 38 sized for releasible connection to eyelets 34 as shown in FIG. 1. Belt connecting members 12 could possibly be metal extension springs or elastic rubber tubing or bands. In this example, belt connecting members 12 are affixed to swivel-eye snap fasteners 38 by crimp fittings 39, although other suitable connectors might work. The opposite ends of belt connecting members 12 are both affixed by crimp fittings 39 to one eye of a single swivel connector 40 having two oppositely disposed eyes, as shown in FIGS. 1 and 4. The other end or eye of swivel connector 40 is affixed to adjustable strap 14 which is fashioned into a loop. The swiveling aspect of swivel connector 40 and the swivel portion of snap connectors 38 is non-critical but desirable since it seems to help prevent twisting and snarling of tether 11 when being transported or used, and are relatively inexpensive to purchase from existing manufacturers.

Adjustable strap 14 is essentially a narrow flexible fabric strap adjustably affixed together to fashion the strap into a size adjustable loop with a buckle 42. Buckle 42 allows for large increment length adjustments of the loop formed of adjustable strap 14 which is shown in an elongated loop form in FIG. 1. Buckle 42 provides for releasibly affixing the loop in a given length with a free end of the strap 14 hanging out of the buckle 42 as reserve material for further increases in the size of the loop, or in effect for further lengthening of tether 11 between the portion thereof which connects to belt 10 and the portion thereof which connects to an exercise machine. Adjustable strap 14 is passed through swivel connector 40 on one end and snap connector 44 on the other prior to being affixed into a loop form with buckle 42 as shown in FIGS. 1 and 4. The overall length of tether 11 should be adjustable between about one foot and three feet or so, counting the length of members 12 between the attachment of the tether 11 to belt 10 and the structural member 60 of the exercise machine 52 which the other end of the tether 11 is attached. This range of possible length of tether 11 is to accommodate various exercise machines 52 each of which require the user to position himself a certain distance from the front of the machine while exercising.

Snap connector 44 shown in FIG. 1 and 4 is releasably connected to the central section of attachment strap 16 by a small reinforced fabric loop 45 sewn or otherwise securely affixed to the outer surface of strap 16. Although snap connector 44 is not absolutely necessary between adjustable strap 14 and loop 45 of strap 16, the ease at which strap 16 may be replaced for whatever reason due to connector 44 is desirable, but adjustable strap 14 could simply be passed through loop 45, and the small expense of snap connector 44 could be eliminated. Attachment strap 16 is comprised of a flexible rubber or fabric belt sized substantially smaller than belt 10. Both terminal free ends of attachment strap 16 are affixed with hook and loop fasteners 26 B in a similar manner to that of belt 10, which allows the ends to be overlapped onto themselves for attachment around a narrow structural member 60. As one may ascertain from FIG. 4, the hook and loop fastener 26 B portions of strap 16 are quite long so as to allow the strap 16 to be snugly affixed around a variety of sizes of structural members 60 on exercise machines 52. Attachment strap 16 should be sized to attach around structural members as large as five inches across or in diameter, and as small as one inch across or in diameter, however this range could obviously be changed if required. Attachment strap 16 may have an inner surface which is affixed with a thin layer of flexible foam rubber 46 to serve as a frictional element between strap 16 and member 60 to help prevent attachment strap 16 from slipping downward when attached around a vertical slick surface such as a painted or unpainted pipe. I have considered making attachment strap 16 at least in part of elastic material, as this may help prevent downward slipping, and allow the strap 60 to fit snugly around a larger variety of members 60 or pipe sizes.

Tether 11 seems to work well when structured as a "Y", that is, providing a two point connection to the frontal oppositely disposed side regions of belt 10 and then essentially extending to a single point for connection to a member of the exercise machine as one may ascertain from FIG. 1. Also see FIG. 9. The "Y" configuration of tether 11 with the two belt connecting members 12 connecting to tabs 36 on the frontal sides of belt 10 applies pull more to the sides of belt 10 as opposed directly to the front of belt 10, and when pull is applied more to the sides of belt 10, a different and more supportive feeling is received by the wearer, that is, instead of pulling the front of the belt away from the user's abdomen, the tension is transferred more into the lumbar area. With the "Y" configuration, due to the small degree of back and forth waist rotation of the user while exercising, the elasticity in the tether 11 should be either in tabs 36 or in belt connecting members 12 or possibly both, so that with rotation of the waist, one elastic member on one side of the belt is stretching and the other elastic member is retracting.

Figure 6:
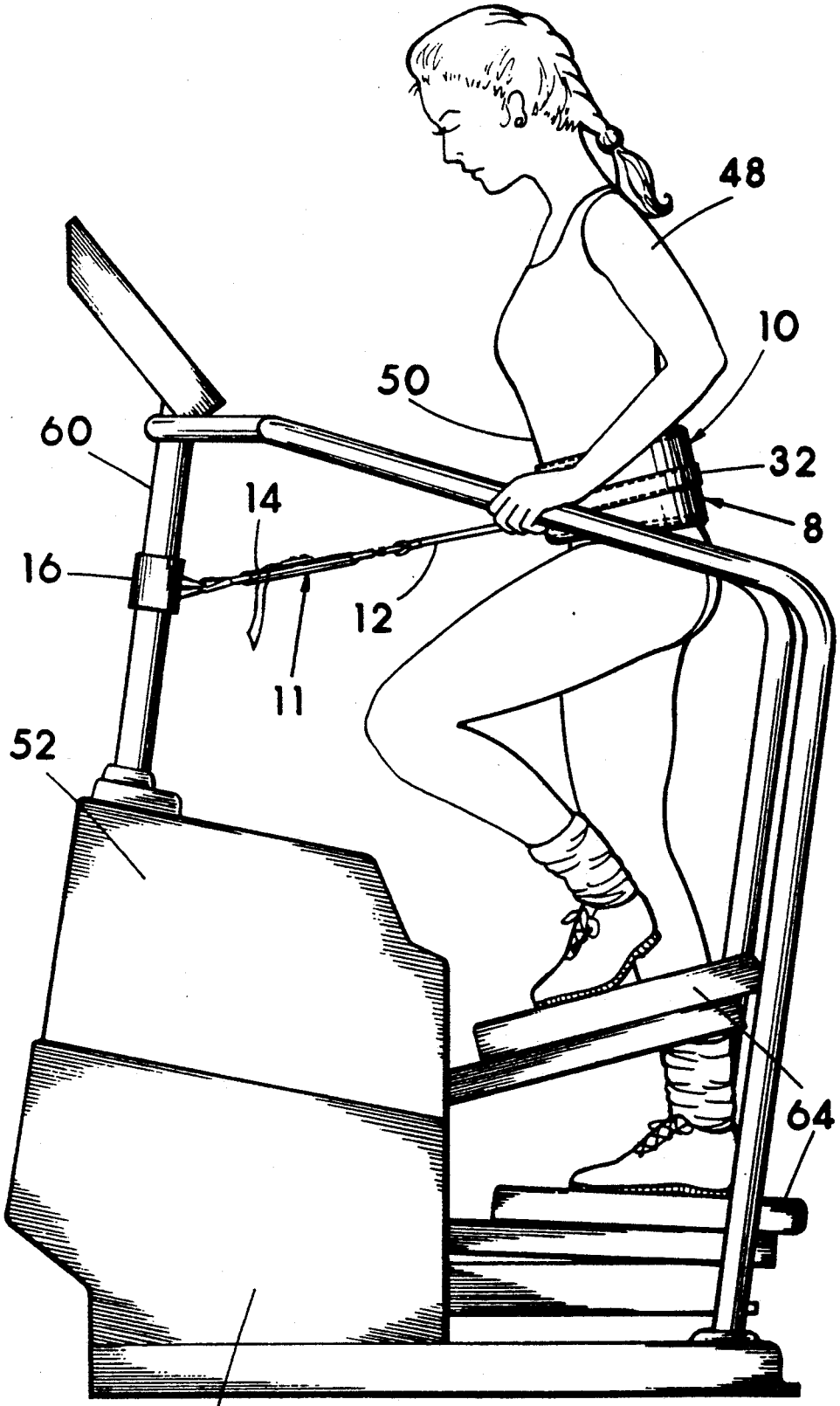
FIG. 6 is an in-use illustration of a belt and tether worn by a person utilizing a stair stepping machine in accordance with the invention.
Figure 7:
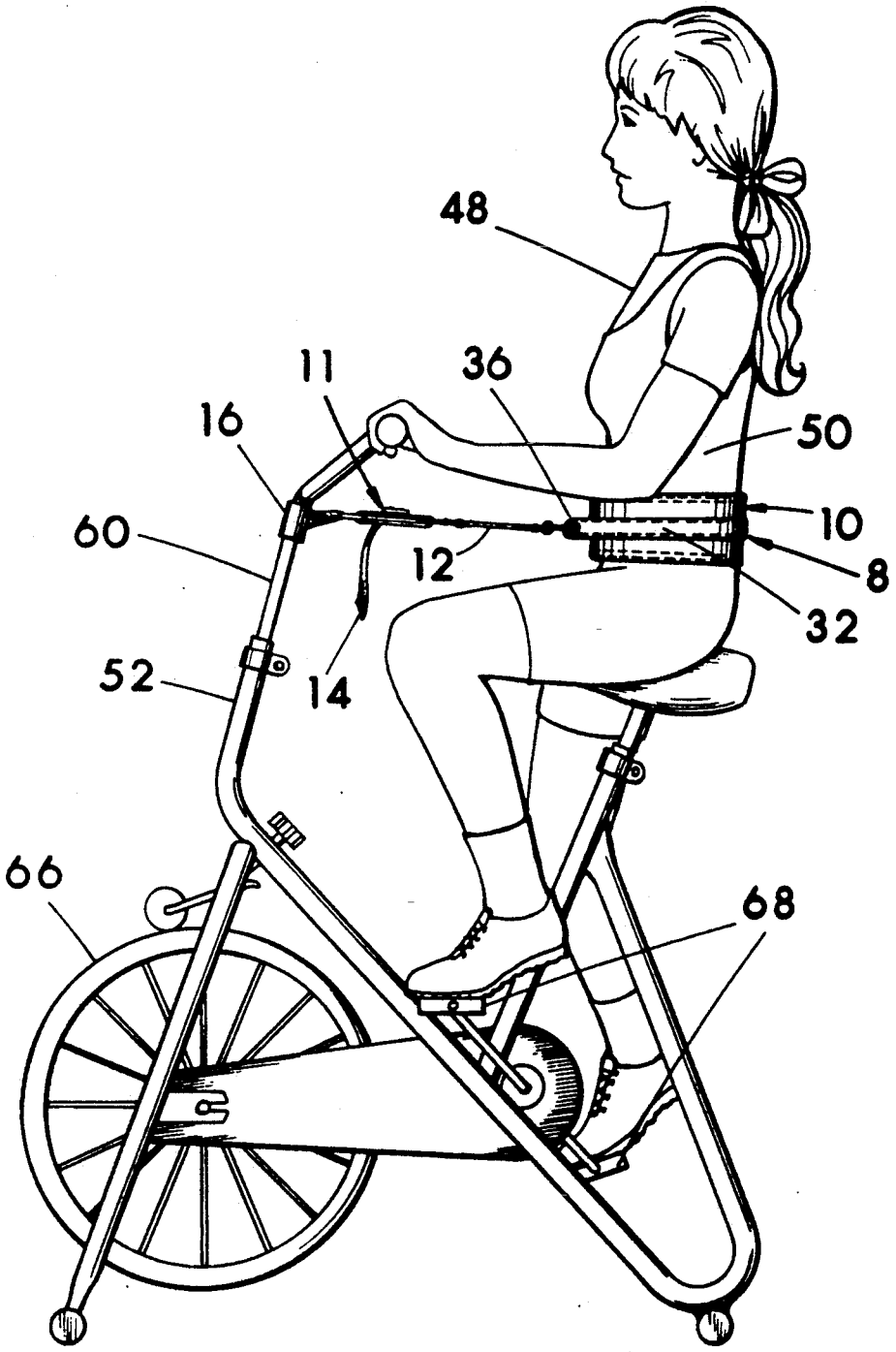
FIG. 7 is an in-use illustration of a belt and tether being worn by a person utilizing a stationary exercise bicycle in accordance with the invention.

To utilize belt 10 and tether 11, user 48 may disconnect belt 10 from one belt connecting member 12 and then wrap belt 10 around the midriff or waist 50 with interior surface 20 adjacent user 48. Ends 24 of belt 10 are secured with hook and loop fasteners 26 so belt 10 is affixed around the waist rather snugly with caution being taken to properly place pad 28 and groove 30 relative to the spine in the lumbar area. User 48 then attaches the remaining belt connecting member 12 to the other eyelet 34 with swivel-eye snap fastener 38. If it is not already affixed in place, attachment strap 16 is then wrapped around a stationary structural member 60 of exercise equipment 52, preferably a vertical member located directly in front of user 48, such as is shown in FIGS. 6 and 7 on exercise equipment generally designated by 52. Adjustable strap 14 allows manual adjustment in the distance between user 48 or belt 10 and member 60 of exercise equipment 52 to which tether 11 is attached. The properly adjusted length with user 48 in place to exercise, should be stretching attachment members 12 somewhat, but not to their stretch limits. The length of tether 11 needs to be initially manually set by user 48 to the particular exercise machine 52 and to the particular tension preference of user 48 through buckle 42.

If user 48 is using exercise equipment 52 such as the stair stepping machine 62 shown in FIG. 6, attachment strap 16 may be affixed to central structural member 60 which supports the hand rails and display panel, and user 48 stands on steps 64. While holding the hand rails, user 48 alternates lifting each foot and leg as steps 64 move up and provide resistance when forced down, simulating the action of climbing stairs. Due to the pulling tension of belt 10 and tether 11 against the user's waist 50 toward structural member 60, user 48 is urged into a substantially straight posture and avoids a bent over position by essentially leaning back somewhat against belt 10. As steps 64 of stair stepping machine 62 are normally somewhat angled, user 48 may appear in FIG. 6 to be leaning forward, however, user 48 is maintaining a generally straight or proper line down the back to the extended leg, and avoiding bending forward at waist 50 which would create stress on the lower back muscles.

If user 48 is utilizing exercise equipment 52 such as stationary bicycle 66 shown in FIG. 7, attachment strap 16 is affixed to central structural member 60 which is the handle bar support. In use, user 48 sits erect on the seat and places her feet on pedals 68, which when in motion, creates an up and down motion which causes a slight side to side rolling of user 48. The side to side rolling motion does not twist belt 10 on user's 48 waist 50 primarily due to the elasticity of belt connecting members 12. Belt 10 supports user 48 sufficiently to allow user 48 to lean back into an erect position, placing some of her weight against belt 10 while pulling tension from tether 11 pulls her waist somewhat forward and her shoulders naturally move somewhat rearward.

As stated earlier, belt 10 can also be used separately apart from the rest of the device for a weight lifting or exercise support belt, providing tether 11 is detachable from the belt 10. Belt 10 is suitably structured to support the lower back of user 48 by maintaining the spine in a given degree of extension, particularly with the use of pad 28 shown sectioned in FIG. 5. Belt 10, and particularly pad 28, is sufficiently wide to provide the vertical support of the back, which helps to prevent hyper-flexion of the lower thoracic and lumbar area of the spine during exercise. Belt 10 also provides support for the abdominal muscles during especially strenuous exercises.

Figure 8:
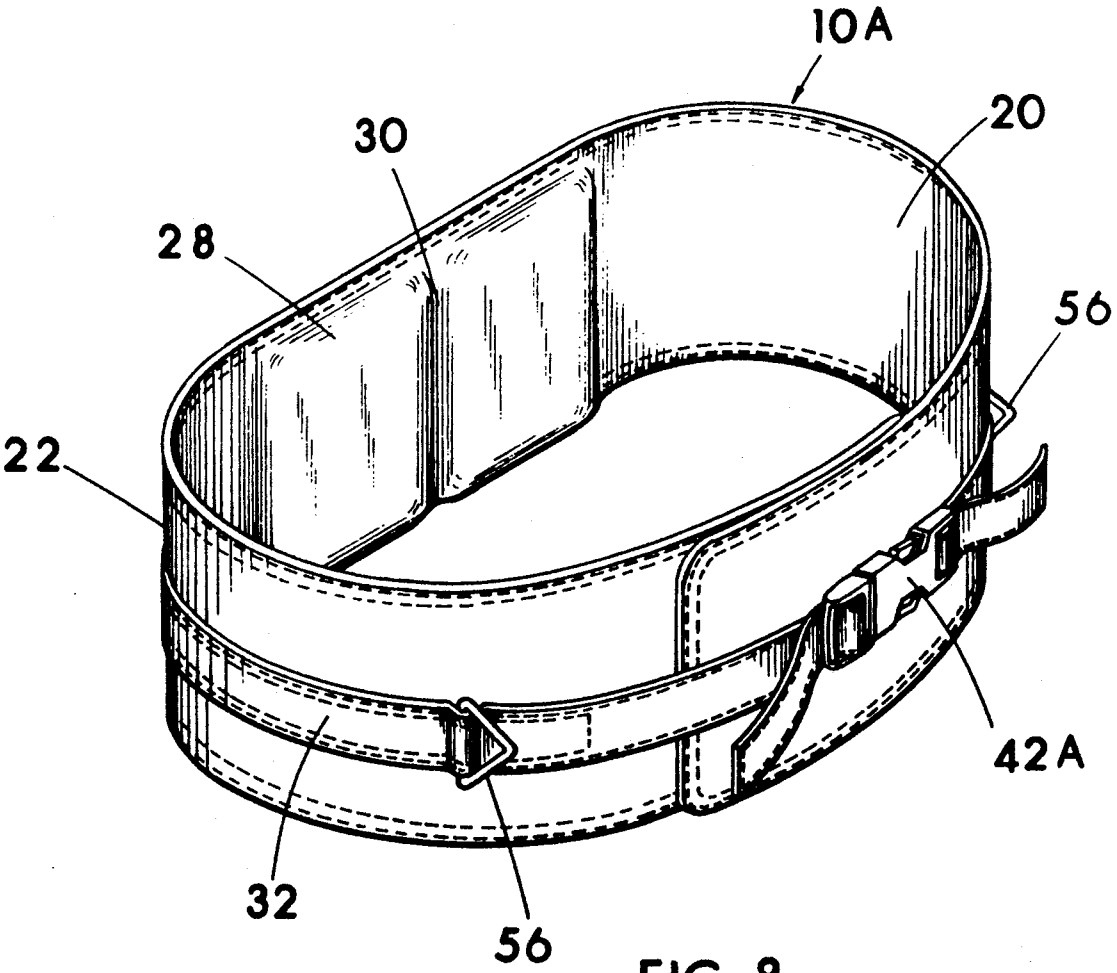
FIG. 8 is a perspective frontal view of a slightly varied second structural embodiment of a suitable belt wherein the eyelets of the first embodiment for connecting the tether have been replaced with "D" rings, and the hook and loop fasteners utilized in the first embodiment belt to affix the belt ends together have been replaced or reinforced with a belt and snap-buckle attachment.
Figure 9:
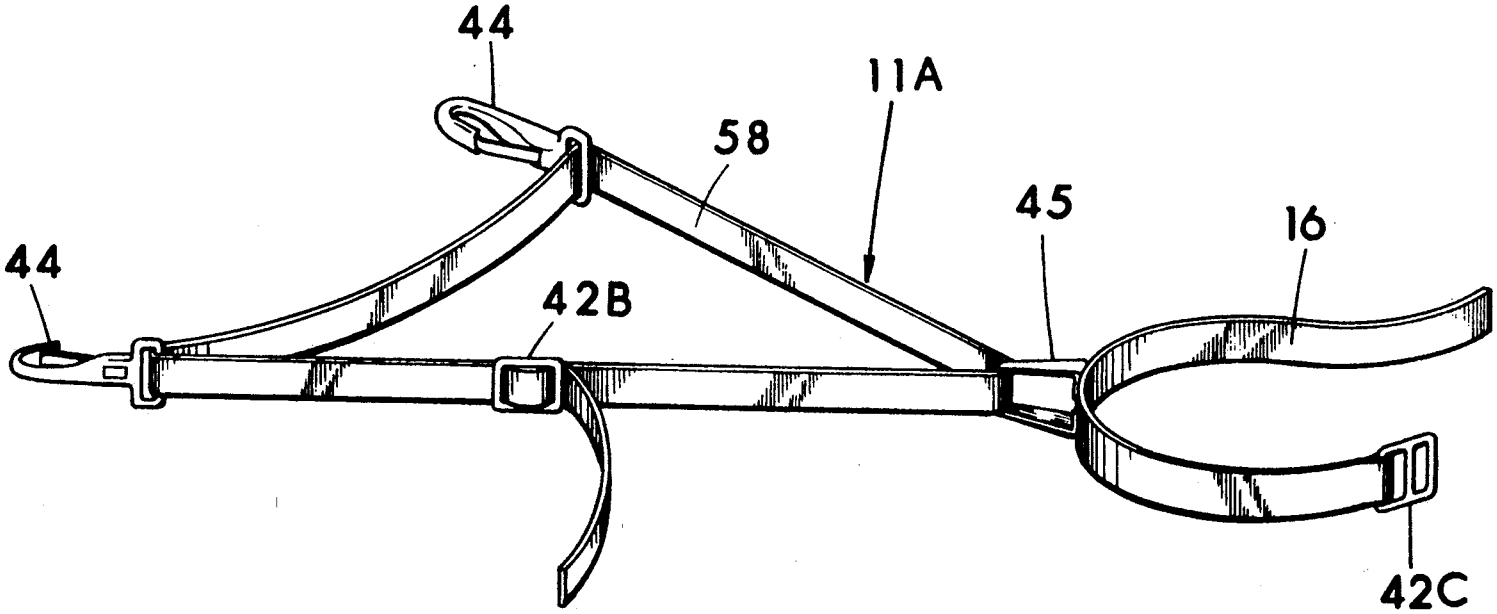
FIG. 9 is a perspective frontal view of a suitable alternative tether embodiment to that shown in FIG. 4.

Although belt 10 has been described as having hook and loop fasteners 26 as the method of attachment, a lengthened belt 32 and buckle 42 A arrangement can also be used as an alternative or supplemental attachment method, as shown in FIG. 8 where a second embodiment belt 10 A is illustrated. Eyelets 34 of belt 10 can also be replaced with "D" rings 56 of belt 10 A, which are affixed to belt 10 A by a stitched fold in the strap 32. As an alternative to two or more separate belt connecting members 12, FIG. 9 illustrates a second tether embodiment 11 A comprising one elongated size or length adjustable loop 58 with two snap connectors 44 which replaces not only belt connecting members 12 of tether 11, but also adjustable strap 14 of tether 11. Loop 58 is also elastic in nature to provide give for user's 48 side to side rotation. Loop 58 is also adjustable in length with the use of buckle 42 B. FIG. 9 also depicts attachment strap 16 utilizing a buckle 42 C attachment instead of the hook and loop fasteners 26 B of tether 11.

An important factor in the successful structuring and functioning of this invention involves the elasticity of it's members for the reasons previously described. This elasticity can conceivably be incorporated into other members of the device other than belt connecting members 12, tabs 36 or loop 58. For instance, attachment strap 16 could be elasticized, as could loop 45, or adjustable strap 14 for example.

It is known that many people already own and use general exercise or weight lifting belts, and in view of this, another way in which to provide the benefits of my invention may be with a relatively inexpensive belt which functions in conjunction with the user's existing general exercise or weight lifting belt. Although not shown in the drawings, this relatively inexpensive belt would be an elongated flexible belt having two oppositely disposed terminal ends each having an eyelet or equivalent structure to allow the attachment of a tether 11 or 11 A or equivalent. The belt would be placed around the back of the user's waist over the outside of the user's existing general exercise or weight lifting belt. The terminal ends of this inexpensive belt would terminate in the approximate position of tabs 36 of belt 10. This relatively inexpensive belt would not fasten completely around the user's waist, but instead would be removably attached to the exterior of the user's existing belt by hook and loop fastener, tie strings, snaps or the like.

My invention has been described above and shown in the drawings by way of example to allow those skilled in the art to both build and use my invention without having to preform undue experimentation. Many changes may be made in the specific examples described and shown without departing from the true scope of my invention. The alternative examples shown and described do not constitute an exhaustive list of suitable alternatives, particularly structural alternatives to the belt and the tether of which I have contemplated. Therefore the true scope of the invention should be determined by a fair and reasonably broad interpretation of my claims.

What I claim as my invention is:

1. A method of promoting and assisting in maintaining proper body alignment, particularly spinal alignment of a person exercising with alternating leg movements on an exercise machine, with said method including the use of an adjustable belt affixed snugly around the person's waist and an elongated tether means affixed at a first end thereof to said belt, said tether means being of a type having manual length adjustability means so as to allow the length of said tether means to be manually adjusted when desired, said method including affixing a second end of said tether means to a stationary structural member of the exercise machine directly in front of the person's abdomen, said method further including the person initially manually adjusting the length of said tether means by manipulating said manual length adjustability means to a length so that during exercise with the person's abdomen toward the structural member of the exercise machine, a continuous pulling tension is applied against said belt by said tether means, wherein said continuous pulling tension against said belt results in applying generally continuous pulling pressure primarily in the lumbar area of the person toward the structural member of the exercise machine in front of the person, said method further including the use of flexible means and of elasticizing means within said tether means so as to render said tether means resiliently extensible for providing both shock absorbtion and length adjustability in said tether means as the person rotates slightly from side to side and moves somewhat forward and away from the structural member of the exercise machine during exercising with alternating leg movements.

2. A method according to claim 1 wherein said belt includes padding at least in an area of said belt which is placed in the person's lumbar area during use.

* * * * *